United States Patent [19]

Koss

[11] Patent Number: 4,678,189

[45] Date of Patent: Jul. 7, 1987

[54] BASKETBALL RETURN DEVICE

[76] Inventor: Richard E. Koss, 3530 E. 8th Ave., Denver, Colo. 80206

[21] Appl. No.: 761,320

[22] Filed: Aug. 1, 1985

[51] Int. Cl.[4] ..... A63B 69/00

[52] U.S. Cl. ..... 273/1.5 A; 124/50; 124/78; 273/395

[58] Field of Search ..... 273/1.5 A, 394–397; 124/78, 50

[56] References Cited

U.S. PATENT DOCUMENTS

| | | | |
|---|---|---|---|
| 1,765,269 | 6/1930 | Hatley . | |
| 2,700,379 | 1/1955 | Brigati | 124/50 X |
| 2,808,264 | 10/1957 | Scalf | 273/1.5 |
| 3,018,769 | 1/1962 | Parsoneault | 124/50 X |
| 3,085,800 | 4/1963 | Holstad | 273/1.5 |
| 3,105,683 | 10/1963 | Kimbrell | 273/1.5 |
| 3,233,896 | 2/1966 | King | 273/1.5 |
| 3,308,802 | 3/1967 | Applegate | 124/78 |
| 3,446,504 | 5/1969 | Pascucci | 273/1.5 |
| 3,471,150 | 10/1969 | Kaerwer | 273/1.5 |
| 3,776,550 | 12/1973 | McNabb | 273/1.5 |
| 3,799,543 | 3/1974 | Steel, Jr. | 273/1.5 |
| 3,814,421 | 6/1974 | Spier, Jr. | 273/1.5 |
| 3,901,506 | 8/1975 | Caveney | 273/1.5 |
| 3,917,263 | 11/1975 | Wiley | 273/1.5 |
| 4,193,591 | 3/1980 | Paulson | 124/78 |
| 4,280,697 | 7/1981 | Yuasa | 124/78 X |
| 4,323,048 | 4/1982 | Saito et al. | 124/78 |
| 4,352,348 | 10/1982 | Griffith | 124/78 |
| 4,372,284 | 2/1983 | Shannon et al. | 124/78 |
| 4,561,414 | 12/1985 | Nozato | 124/78 |
| 4,579,340 | 4/1986 | Jenkins et al. | 273/1.5 A |

FOREIGN PATENT DOCUMENTS

| | | | |
|---|---|---|---|
| 2095565 | 10/1982 | United Kingdom | 124/78 |

*Primary Examiner*—Paul E. Shapiro

[57] ABSTRACT

A ball return device for aiding in the practice of basketball or other games which require that a ball be returned to the player in order to perform repetitive practice routines. The device comprises a receiving basket which may be placed under a basketball hoop and which directs a ball to a pair of rotating heads operable to propel the ball in the direction of the player. An electronic sensing device is operable to change the position of the return mechanism in response to movement of the player and thereby direct balls to the player as he moves about the court. The propelling head may be adjusted to change the elevation at which the ball is propelled and further adjusted to change the force with which the ball is propelled in order to effectively deliver a ball to virtually any location on a basketball court.

1 Claim, 3 Drawing Figures

BASKETBALL RETURN DEVICE

BACKGROUND AND FIELD OF THE INVENTION

The present invention relates to a device for aiding in the practice of basketball or other games which require that the ball be returned to the player in order to perform repetitive practice routines. More specifically, the present invention comprises a means for returning the ball to the player after it has passed through a basket. The return mechanism of the present invention comprises a receiving basket, a delivery track and a propelling means for directing a ball toward the player. An electronic sensor on the mechanism detects movement of the player and controls the position of the mechanism to direct the ball toward a player at different positions as he moves about a court.

It is well known that basketball players must spend a great deal of time practicing in order to become proficient in the game. Because of the large dimensions of the basketball court, however, much time is wasted chasing stray balls after they have passed through a basket. Such wasted time is particularly frustrating to an experienced ball player attempting to perfect his technique since even a properly thrown ball will not return to him after it has passed through the net of the goal.

Prior art basketball return mechanisms have generally been in the form of passive devices which do no more than direct the ball to the general vicinity of the player. Such devices provide little improvement over having no return mechanism at all.

SUMMARY OF THE INVENTION

The present invention overcomes the shortcomings of the prior art by providing a basketball return mechanism which may be placed under a hoop or basket and which directs a ball having passed through the hoop or basket to a pair of rotating heads which propel the ball in the direction of the player. An electronic sensing device is operable to change the position of the return mechanism in response to movement of the player and thereby direct balls to the player as he moves about the court. The propelling heads may be adjusted to change the elevation at which the ball is propelled and further adjusted to change the force with which the ball is propelled in order to effectively deliver a ball to virtually any location on a basketball court.

DETAILED DESCRIPTION OF THE PREFERRED EMBODIMENT

Figure 1:
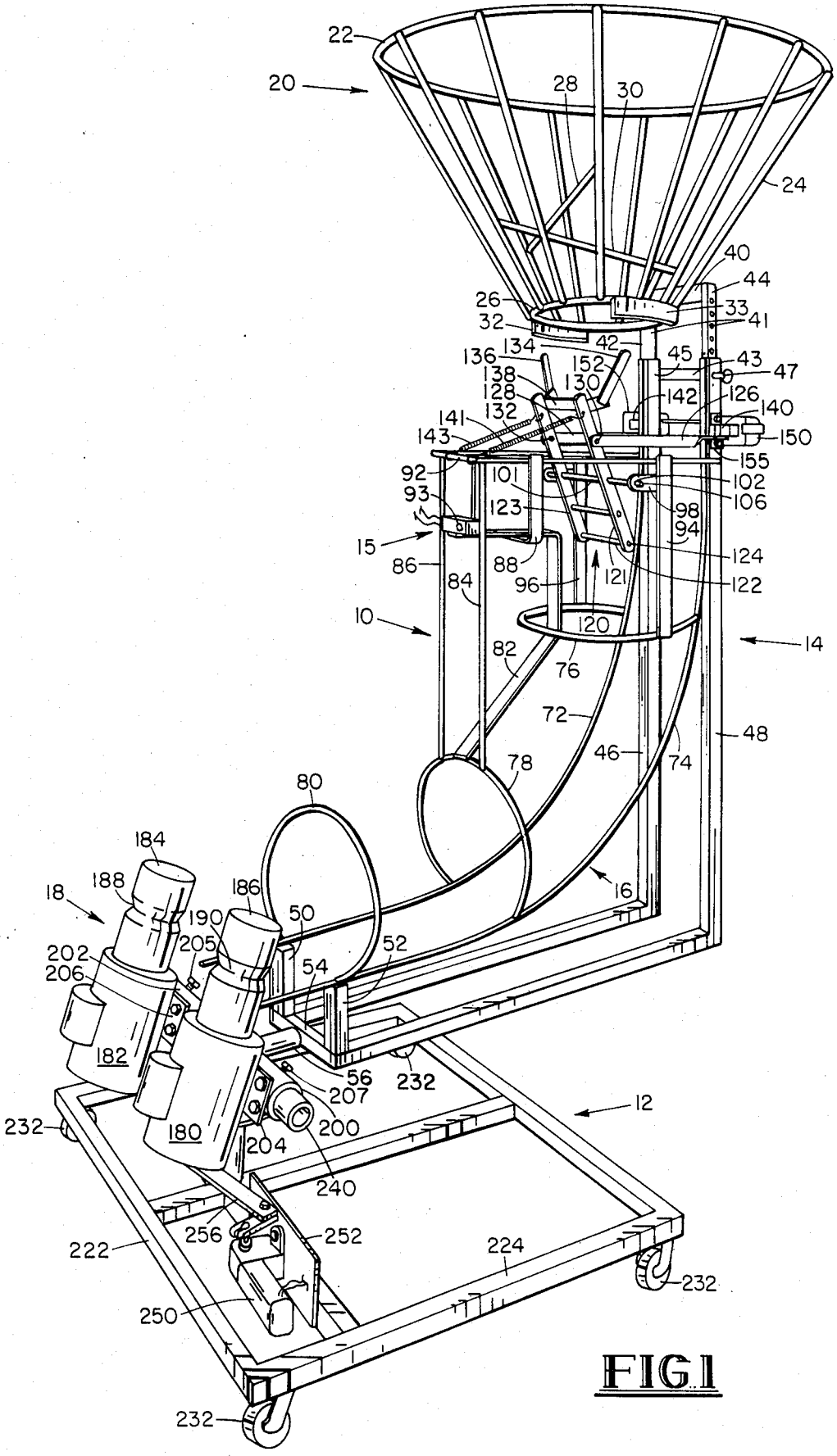
FIG. 1 is a perspective view of the basketball return mechanism of the present invention.

The basketball return mechanism 10 of the present invention is shown generally in FIG. 1. The device consists generally of a lower wheeled support frame 12, a movable upper support frame 14 pivotally mounted on the lower support frame, a receiving basket 20 for receiving a ball after having passed through a net, a delivery track 16, and a propelling mechanism 18 for propelling the ball to a player. A sensing device 15 detects movement of the player about the court and is operable to control a servo mechanism to cause movement of the upper support frame 12 to "track" the player.

Figure 2:
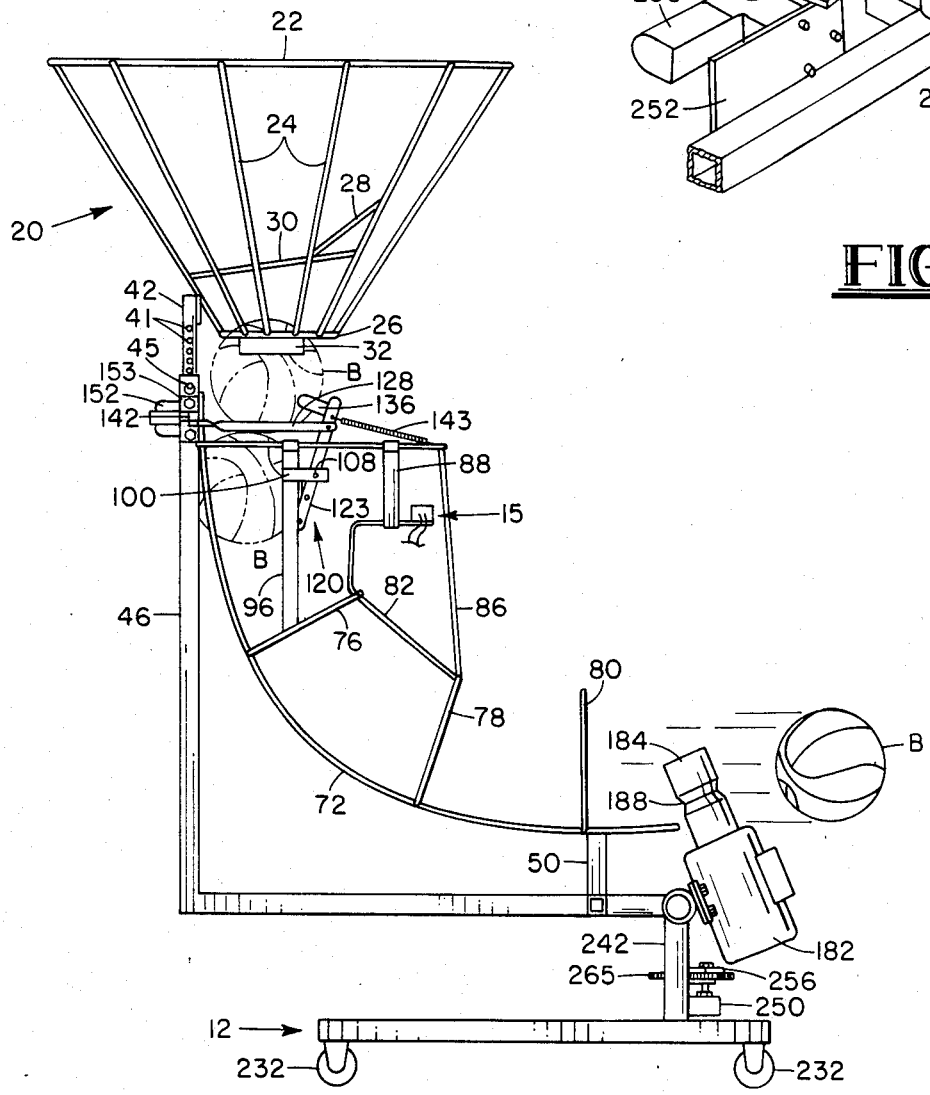
FIG. 2 is a side view of the basketball return mechanism of the present invention showing details relating to the transport of a ball through the receiving basket, along the delivery track, and to the propelling mechanism.

As may be seen in FIGS. 1 and 2, the receiving basket 20 is in the form of an inverted truncated cone. The basket 20 comprises an upper annular ring 22, a lower annular ring 26 and a multiplicity of radially-spaced support bars 24 extending from the upper ring 22 to the lower ring 26. A pair of rectangular guards 32, 33 are attached to the lower ring 26 on opposite sides thereof to prevent lateral movement of the ball as it passes through the basket. The receiving basket 20, as described above, may be used to direct a single ball to the propelling mechanism after the ball has passed through the basketball net; alternatively, a multiplicity of balls may be stored in the basket and delivered to the player at timed intervals in a manner to be described in greater detail below. When the basket is being used in the latter mode, the balls stored in the basket are prevented from jamming in the bottom of the basket by jam bars 28 and 30 which are attached at oblique angles between pairs of support bars 24 of the basket as shown in FIGS. 1 and 2.

The upper support frame 14 is generally L-shaped and comprises a pair of laterally spaced L-shaped members 46 and 48. The L-shaped members 46 and 48 are secured at their upright end by a cross member 43 and at the terminal ends of the lower horizontal portion by a cross member 54. A centrally disposed mounting shaft 56 is attached to cross member 54 and connects the upper support frame 14 to a T-shaped mounting bar 240 which is pivotally mounted in lower support frame 12.

The upright portions of the L-shaped members each have longitudinally extending cavities adapted to receive vertical legs 42 and 44 of an inverted U-shaped bracket 40 which is attached to two of the longitudinal support arms 24 at the rear of the receiving basket 20. The vertical legs 42 and 44 are received in inner concentric relation within the cavities of the upright portions of L-shaped members 46 and 48 and are movable therein so that the receiving basket 20 may be placed at a multiplicity of vertical positions beneath a basketball goal. The support bracket 40 is secured in the desired position by a pair of bolts 45 and 43 or other suitable fastening means extending through the upright portions of L-shaped members 46 and 48, respectively. Each of the bolts is received in one of a plurality of transverse bores 39 in each of the vertical legs 42 and 44, depending on the desired position of the basket 20.

Balls are transported from the receiving basket 20 to the propelling means 18 by a curved delivery track comprising a pair of curved tubular members 72 and 74. As may be seen in FIG. 2, the curved members 72 and 74 are attached at their upper ends to the upright portions of L-shaped members 46 and 48, respectively, and at their lower ends to upper terminal ends of upright bars 50 and 52, respectively, said upright bars being attached at lower forward ends of L-shaped members 46 and 48. Lateral movement of the ball as it travels along the track is limited by arcuate rings 76, 78 and 80 each of which is attached to curved members 72 and 74 as shown in FIG. 2. Additional guidance is provided by a J-shaped rail 82 attached to upper portions of arcuate rings 76 and 78 as shown in FIGS. 1 and 2.

Structural rigidity of the track assembly is enhanced by an upper support frame comprising a U-shaped upper frame member 92 attached to L-shaped members 46 and 48 of the upper support frame 14. A first set of upright support bars 84 and 86 are each attached on one end to said U-shaped frame 92 at its forward end and depend downward therefrom with the opposite ends of the bars attached to the upper portion of arcuate ring 78 on either side of the point of attachment of J-shaped member 82. A second pair of upright support bars 94 and 96 are attached to the upper frame 92 at an intermediate point on each of the leg members of said frame and depend downward with opposite ends attached to intermediate point on opposite sides of arcuate ring member 76. Support brackets 98 and 100 are attached to upright bars 94 and 96 at upper intermediate point thereof and are used in connection with a support apparatus for the gate of the ball dispensing mechanism, as described below.

As may be seen in FIGS. 1 and 2, the ball dispensing mechanism of the present invention comprises a ladder-like gate member 120 comprising vertical side members 121 and 123 and having a plurality of transverse bars or rungs 122. The gate 120 is supported at a midpoint by a shaft 106 extending through vertical side members 121 and 123, said shaft being received in apertures 102 and 108 in support brackets 98 and 100, respectively. As may be seen in FIG. 1, the gate 120 may be pivoted about its central transverse axis by upper support arms 126 and 128 which are hingedly attached to vertical members 121 and 123, respectively, and slidably secured by brackets 153 and 155 to L-shaped members 48 and 46, respectively.

As may be seen in FIG. 1, the gate is normally biased toward a position at an angle with respect to the longitudinal axis of the upright portion of L-shaped members 46 and 48. The gate is normally maintained in this position by a biasing force provided by spring members 141 and 143. With the gate in the aforementioned position, the basketball may be captured on the upper portion of the track as shown in FIG. 2. A generally U-shaped bracket 138 with upwardly directed arms 134 and 136 is attached to the upper portion of the gate 120 to secure an additional ball for subsequent delivery to the track.

Electromagnetic actuators 150 and 152 are attached to the upright portion of L-shaped members 48 and 46, respectively, and are operable to engage magnets 140 and 142 attached to support bars 126 and 128 and thereby change the position of gate 120 to allow a ball to pass to the delivery track. The actuators may be controlled by a timing circuit or by a sonar or photodetector circuit which senses movement of the player about the court, as described in greater detail hereinbelow. When the actuators are engaged, the magnets on the support arms are drawn toward the actuators and the gate 120 rotates counterclockwise from the position shown in FIG. 2. The ball is thus released and allowed to move along the track and engage the propelling means. When the magnetic actuactors are deactivated, the spring members 141 and 143 move the support arms 126 and 128 and the gate 120 rotates clockwise to resume its normal position and thereby capture another ball for subsequent delivery to the track.

Figure 3:
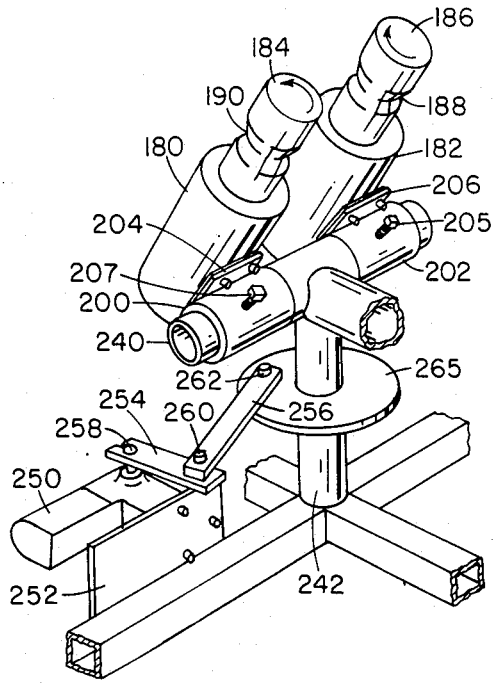
FIG. 3 is a perspective view of the propelling mechanism of the present invention showing details of the mounting of the motors on a swivel base.

Details relating to the ball propelling mechanism may be seen by referring to FIG. 3. The propelling mechanism comprises two electric motors 180 and 182 which are secured by mounting brackets 204 and 206, respectively, attached to annular collars 200 and 202. The annular collars 200 and 202 are slidably mounted on the horizontal shaft of a T-shaped mounting bar which is journaled for rotation on lower support frame 12. Fastening means 207 and 205 are attached to the collars and are operable to frictionally engage the mounting bar and thus secure the motors in a plurality of configurations depending on the desired attitude at which the ball is to be propelled.

As may be seen in FIGS. 1 through 3, rotatable heads 186 and 184 are attached to motors 180 and 182, respectively, to engage a ball passing between the heads. In the preferred embodiment, the heads are covered with rubber to aid in gripping the ball, although bare metal heads may be employed if less gripping effect is desired. As may be seen most clearly in FIG. 3, the head 184 on motor 180 rotates in a counterclockwise direction while the head 186 on motor 182 rotates in a clockwise direction. The spacing between the heads may be adjusted by securing the motors 180 and 182 at various locations along horizontal bar 240, as described hereinabove. The spacing between the heads may, therefore, be adjusted to allow the heads to engage balls having different diameters, such as volley balls.

The azimuthal position of the propelling mechanism is controlled by a servo motor 250 which is responsive to signals provided by the detector 15. The servo motor 50 is secured to transverse member 230 of the lower support frame 12 by a rectangular mounting bracket 252. Movement of the servo motor is translated to the T-shaped mounting bar by a crank mechanism comprising connecting arms 254 and 256 which are coupled to form a crank arm which is attached to a circular platen secured to vertical shaft 242.

The detector means 15 which controls the servo motor 250 may employ either a sonar-type sensor or a photodetector, both of which are commercially available and well known in the art. The sensor is coupled to a feedback circuit which uses an error signal to detect movement of the player and adjust the position of the propelling mechanism and upper support frame to ensure accurate delivery of the ball. A timing circuit is employed to control the magnetic actuators 150 and 152 and thus determine the rate at which balls are delivered to the player. The portion of the timing circuit which controls the actuators is also linked to the feedback circuitry described above and is operative to trigger the actuators, and thus deliver a ball, each time a correction has been achieved in the position of the upper frame 14. With the mechanism operating in this latter mode, a player may move to a number of positions on a court to await delivery of a ball. Once the detection circuitry has determined the new location of the player and activated the servo mechanism to change the position of the ball delivery system, the actuators will immediately deliver a ball to the propelling mechanism for delivery to the player.

While the invention basketball return mechanism has been described in connection with the preferred embodiment, it is not intended to limit the invention to the particular form set forth, but on the contrary, it is intended to cover such alternatives, modifications, and equivalents, as may be included within the spirit and scope of the invention as defined by the appended claims.

I claim:

1. A basketbal return mechanism, comprising:

a lower support frame;

an upper support frame pivotally mounted on said lower frame and rotatable in a horizontal plane with respect to said lower frame, said upper support frame comprising a vertical portion and a horizontal portion;

a basket-mounting frame releasably secured to said vertical portion of said upper frame, said mounting frame securable in a multiplicity of extended vertical positions with respect to said upper frame;

a ball-receiving basket attached to said basket mounting frame, said basket having first and second ends and being adapted to receive a ball through said first end and to pass said ball through said second end;

two rotatable heads carried on said horizontal portion of said upper frame, said head separated by a distance sufficient to allow a ball to pass therethrough, with said ball being engaged by opposing faces of said heads;

first motor means for rotating said heads in opposite directions such that a ball engaged by said opposing faces of said rotating heads is propelled toward a player;

a ball delivery track adapted to transport a ball from said ball-receiving basket to a position between said rotatable heads;

ball retaining means having a first position and a second position, said retaining means operable to restrict passage of a ball from said ball-receiving basket to said delivery track with said ball in said first position and operable to permit passage of said ball with said retaining means in said second position;

means for biasing said retaining means toward said first position;

actuator means for moving said retaining means to said second position;

timer means for activating said actuator means at timed intervals to allow a ball to pass from said ball-receiving basket to said delivery track; and second motor means for rotating said upper frame in a horizontal plane with respect to said lower support frame.

* * * * *